US010912361B2

(12) United States Patent
Wu et al.

(10) Patent No.: US 10,912,361 B2
(45) Date of Patent: Feb. 9, 2021

(54) STRAP ATTACHMENT

(71) Applicant: TUMI, INC., Edison, NJ (US)

(72) Inventors: Peter C. Wu, Sunnyside, NY (US); Paul V. Scicluna, Penndel, PA (US); Michael Greisser, Flushing, NY (US)

(73) Assignee: TUMI, INC., Edison, NJ (US)

( * ) Notice: Subject to any disclaimer, the term of this patent is extended or adjusted under 35 U.S.C. 154(b) by 101 days.

(21) Appl. No.: 16/073,032

(22) PCT Filed: Jan. 26, 2017

(86) PCT No.: PCT/US2017/015042

§ 371 (c)(1),
(2) Date: Jul. 26, 2018

(87) PCT Pub. No.: WO2017/132317

PCT Pub. Date: Aug. 3, 2017

(65) Prior Publication Data

US 2019/0029384 A1 Jan. 31, 2019

Related U.S. Application Data

(60) Provisional application No. 62/287,296, filed on Jan. 26, 2016.

(51) Int. Cl.

| | |
|---|---|
| ***A45C 13/30*** | (2006.01) |
| ***A45C 13/10*** | (2006.01) |
| ***A45C 13/22*** | (2006.01) |

(52) U.S. Cl.

CPC ..... *A45C 13/30* (2013.01); *A45C 13/1076* (2013.01); *A45C 13/1092* (2013.01);
(Continued)

(58) Field of Classification Search

CPC . A45C 13/30; A45C 13/1092; A45C 13/1076; A45C 13/22; A45C 2013/223;
(Continued)

(56) References Cited

U.S. PATENT DOCUMENTS 655,127 A * 7/1900 Stock ..... A44B 11/2561 24/628
2,477,575 A * 8/1949 Bubser, Jr. ..... B64D 17/32 24/701

(Continued)

OTHER PUBLICATIONS

International Search Report and Written Opinion in Application No. PCT/US2017/015042 dated Apr. 7, 2017.

*Primary Examiner* — Robert Sandy
*Assistant Examiner* — Rowland Do
(74) *Attorney, Agent, or Firm* — Lando & Anastasi, LLP

(57) ABSTRACT

A strap attachment device includes a strap connector configured to attach to a strap and a connecting plate secured on the surface of an article such as a bag or suitcase. The strap connector includes a connector post configured to removably engage and be secured by a locking member located beneath the connecting plate. The locking member is biased into a closed position by a mechanical biasing means, such as a spring. The connector post may include a flanged end configured to partially disengage the locking member causing the flanged end to mate with and be secured by the locking member responsive to being inserted into the connecting plate. A pull tab is further disposed on a pull track within the connecting plate. A user can disengage the connector post from the locking member by moving the pull tab along the pull track.

20 Claims, 11 Drawing Sheets

(52) U.S. Cl.
CPC ..... *A45C 13/22* (2013.01); *A45C 2013/223* (2013.01); *A45C 2013/303* (2013.01); *A45C 2013/306* (2013.01)

(58) Field of Classification Search
CPC ..... A45C 2013/303; A45C 2013/306; Y10T 24/45257; Y10T 24/45597; Y10T 24/45262; Y10T 24/4566; Y10T 24/4567; Y10T 24/45743; Y10T 24/45775; Y10T 24/45785; A44B 17/0011; A44B 11/2592
USPC ..... 190/102; 292/DIG. 50
See application file for complete search history.

(56) References Cited

U.S. PATENT DOCUMENTS

| | | | | | |
|---|---|---|---|---|---|
| 2,537,750 | A | | 1/1951 | Gretschel | |
| 3,484,894 | A | * | 12/1969 | Fletcher | A47B 95/02 16/422 |
| 3,513,510 | A | * | 5/1970 | Copes | A44B 11/2515 24/323 |
| 5,178,198 | A | * | 1/1993 | Fitzgerald | A45C 13/26 150/104 |
| 6,374,467 | B1 | * | 4/2002 | Chen | A45C 7/0045 190/102 |
| 6,640,400 | B1 | | 11/2003 | Chen | |
| 7,490,876 | B2 | * | 2/2009 | Kihara | A45C 13/1084 292/341.12 |
| 9,010,279 | B1 | | 4/2015 | Saber et al. | |

* cited by examiner

STRAP ATTACHMENT

FIELD

This disclosure relates to a removable strap attachment for removably attaching a strap to a luggage item or bag.

BACKGROUND

Bags and luggage items often times include a strap for holding, carrying, or pulling the bag or luggage item. Often times, the strap may be releasably attached to the bag using a clip or a hook. One common example of a strap attachment mechanism is a spring-loaded clip whereby a user may place a metal hook through a loop or metal eyelet attached to the bag or luggage item. Once the hook is extended through the loop or luggage item, a spring-loaded lever may close, thereby securing the hook onto the loop or eyelet. Another common strap attachment mechanism uses a hook with a spring-loaded clip bolt. In this example, the strap attachment employs a hook with a spring-loaded clip bolt. In order to attach the strap to the bag or luggage item, a user must pull down a spring-loaded bolt, place the hook through a loop or eyelet on the bag or luggage item, and then release the spring-loaded bolt, securing the strap to the bag.

SUMMARY

This disclosure relates to systems, methods, and apparatuses for providing a strap attachment to connect a strap to a bag or luggage item.

Aspects and embodiments herein describe an improved strap attachment device for removably attaching a strap to an article such as a bag or suitcase. The improved strap attachment device includes a connecting plate configured to be attached to a surface material, for example the surface material of a bag or suitcase, and a strap connector configured to be attached to a strap of a bag or suitcase, and the strap connector is configured to removably attach to the connecting plate.

In various aspects and embodiments of described herein, the strap connector may have two ends, one end being configured to attach to a strap and the other end being configured to attach to the connecting plate. A bore can be provided in the surface of the connecting plate allowing a flanged connector post included on the strap connector to penetrate the connecting plate and removably engage a locking member, which may be housed beneath the connecting plate. The locking member may be biased into an engaged position by a spring and may include a ramped locking point adapted to cause the spring to compress in response to the flanged connector post being inserted into the connecting plate. The strap connector, connecting plate, flanged connecting post, connector bore, locking member, locking point, and other system components may be sized, shaped and arranged such that the strap connector is prevented from being orthogonally or laterally displaced relative to the connecting plate while in the engaged position. In certain embodiments, however, the strap connector may still be able to rotate in a radial direction even while engaged.

The connecting plate may further include a pull tab disposed within a pull track, the pull tab being coupled to the locking member. The pull tab may be moved along the pull track causing the spring to compress and biasing the locking member into a disengaged position, wherein the flanged connector post is released from the connecting plate.

In various aspects and embodiments, the strap connector may include a T-shaped bar with flanged end portions configured to secure the strap on a horizontal portion of the T-shaped bar. The T-shaped bar may further include a vertical portion for connecting the horizontal portion to a plug. The plug may be configured to receive and secure an attachment portion of the flanged connector post, and may further include a projection configured to engage an inner surface of the connector bore such that the flanged connector post cannot be displaced in a lateral direction parallel to the first plane while engaged. In some embodiments, the projection may be circular or cylindrical and allow the connector post to rotate freely in a radial direction parallel the first plane without being laterally displaced.

Additional aspects and embodiments the invention may also comprise a backplate disposed behind or underneath the surface material and configured to secure the connecting plate to the surface material. The backplate may provide one or more rigid mounting points for anchoring the connecting plate to the surface material using one or more rivets, screws, or other fastening means known to those in the art. A reinforcement material sized and shaped to substantially match the dimensions of the connecting plate or backplate may further be disposed behind or underneath the surface material for protecting the surface material against mechanical forces exerted by the connecting plate or backplate.

In certain aspects and embodiments, the flanged connector post may also include a rounded lower surface configured to engage the ramped locking point and further encourage the locking member to disengage. Specifically, the rounded lower surface may contact the ramped locking point at an angle more closely aligned with the locking member's direction of motion. The flanged connector post may further include a cylindrical body portion configured to abut and secure the ramped locking point in the lateral direction once the flange of the connector post has been secured beneath the locking point and the strap connector is fully engaged.

In further aspects and embodiments described herein, the locking point may include a ramped leading surface or edge configured to help urge the locking member to compress responsive to the flanged connector post being inserted into the connector bore and contacting the leading edge or surface of the locking point. The locking point may also include a concave leading edge designed to contact the cylindrical body portion such that the cylindrical body portion can rotate freely in a radial direction relative to the ramped locking point while increasing an amount of surface area contact between cylindrical body portion and the locking point, which can further enhance both the lateral and orthogonal stability of the connector post relative to the locking member and connecting plate.

According to aspects and embodiments of the strap attachment device described herein, the strap attachment device may possess any combination of or all of the structural features and functionality described above.

Certain aspects and embodiments of the present invention include a bag or suitcase comprising a strap, a surface material, and any or all of the structural features and functionality of the strap attachment device described above. Specifically, the strap connector may be attached to the strap and the connecting plate may be affixed to the surface material of the bag or suitcase.

BRIEF DESCRIPTION OF THE DRAWINGS

Various aspects of at least one implementation of a strap attachment are discussed below with reference to the accompanying figures. The figures are provided for the purposes of illustration and explanation and are not intended as a definition of the limits of the disclosure.

DETAILED DESCRIPTION

It should be understood that the following descriptions are not intended to limit the disclosure to an exemplary implementation. To the contrary, it is intended to cover alternatives, modifications, and equivalents as may be included within the spirit and scope of the described subject matter.

Known strap attachments have several potential drawbacks. First, known strap attachments tend to be bulky, mechanical fasteners with limited aesthetic appeal. They tend to be conspicuous on bags and luggage items although designers desire to minimize their impact on the overall appearance of the bag. Secondly, known strap attachments can be awkward to install, often requiring both of the users hands to hold the loop or eyelet in place while inserting a hook through the loop or eyelet and possibly also depressing a spring-loaded bolt or lever. Therefore a strap attachment that may be deployed with one hand only may be desirable. Third, known strap attachments typically have a limited range of motion because mechanisms using a hook cannot rotate around the entire circumference of the loop or eyelet to which they are attached. Typically the connecting loop or eyelet is attached to the bag, itself, and the hook is incapable of traversing the portion of the loop or eyelet that is attached to the bag. Thus, there remains a need for a strap attachment that may connect a strap to a bag or luggage item in such a way as to allow for a fuller range of motion for the user holding the strap.

Figure 1C:
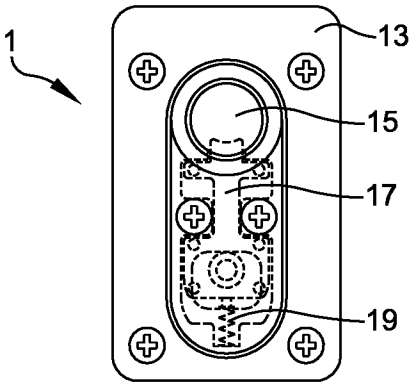
FIG. 1C depicts a bottom, partially transparent view of the strap attachment device in the closed position according to one implementation of this disclosure.
Figure 1B:
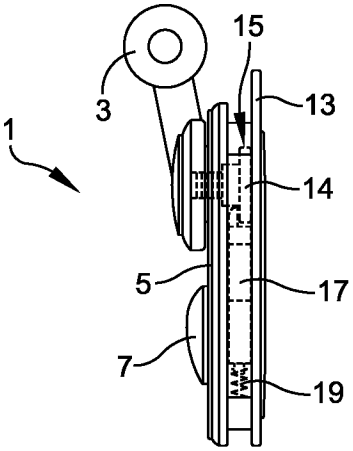
FIG. 1B depicts a side, partially transparent view of the strap attachment device in the closed position according to one implementation of this disclosure.
Figure 1E:
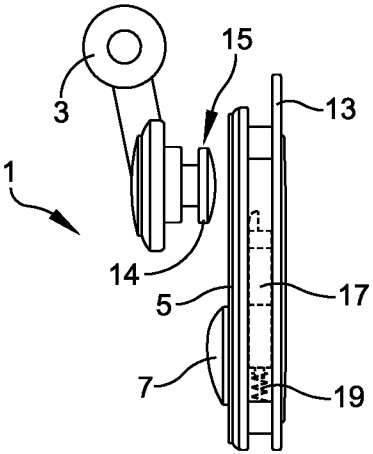
FIG. 1E depicts a side, partially transparent view of the strap attachment device in the open position according to one implementation of this disclosure.
Figure 1A:
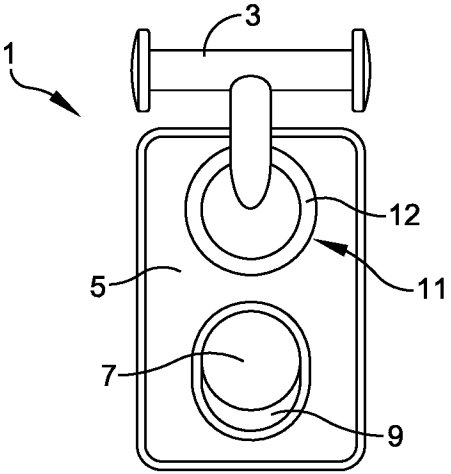
FIG. 1A depicts a top view of a strap attachment device in a closed position according to one implementation of this disclosure.

Referring to FIGS. 1A-1C, there is disclosed an implementation of a strap attachment device 1. FIG. 1A depicts a top view of a strap attachment device 1 in a closed position according to one implementation of this disclosure. As shown in this example, a strap attachment device 1 includes a strap connector 3 illustrated as connected to a connector plate 5. The connector plate 5 has a pull tab 7 illustrated in a closed position, a recessed pull track 9, and a connector bore 11. FIG. 1B depicts a side, partially transparent view of the strap attachment device 1, while FIG. 1C depicts a bottom, partially transparent view of the strap attachment device 1 in a closed position according to one implementation of this disclosure. As shown in FIG. 1B, the strap attachment device 1 may also include a backplate 13 for attaching the strap attachment to a surface of a bag or luggage item. Strap connector 3 may also include a strap connector post 15, which may be inserted into or through the connector bore 11 for locking with locking member 17. An embodiment of the locking member may be a locking bolt. The connector bore 11 may include a ramped or recessed perimeter portion 12 configured to aid the insertion of the strap connector post 15 into the connector bore 11. The locking member 17 may be urged to a closed position by a spring 19 or other mechanical biasing means known to those skilled in the art. As shown, when the strap attachment device 1 is in a closed position, locking member 17 engages a flange or lip 14 on strap connector post 15, thereby retaining strap connector 3 in a closed position such that the connector post 15 remains locked by the locking member 17. FIG. 1C depicts a bottom, partially transparent view of a strap attachment device 1 in a closed position according to one implementation of this disclosure.

Figure 1D:
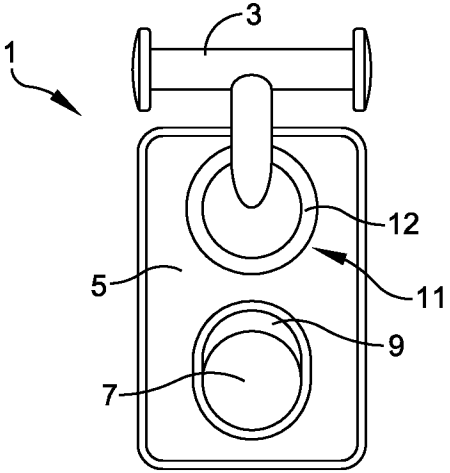
FIG. 1D depicts a top view of the strap attachment device in an open position according to one implementation of this disclosure.

FIGS. 1D-1E respectively depict a top and side view of a strap attachment in an open position according to one implementation of this disclosure. As shown, for example, in FIG. 1D, a user may release strap connector 3 by moving the pull tab 7 within the pull track 9 in a downward direction so as to disengage the locking member 17 from the connector post 15, resulting in compression of the spring 19. Referring, for example to FIG. 1E, once the strap connector 3 and the connector post 15 have been withdrawn from the connector bore 11, the pull tab 7 may be released and spring 19 may decompress, thereby returning the pull tab 7 and the locking member 17 to its biased position (also referred to as the resting position, the locking position, or the engaged position). In various additional embodiments, an orientation of the recessed pull track 9 may differ from the vertical orientation depicted in FIGS. 1D-1E such that the pull tab 7 is movable in a direction corresponding to the pull track's orientation in order to disengage the locking member 17. In a preferred embodiment, the diameter or width of the pull tab 7 is oriented along a plane parallel to a plane along which the connecting plate 5 is oriented. Accordingly, the preferred motion of the pull tab 7 along the pull track 9 responsively occurs in a direction parallel to the plane along which the connecting plate 5 is oriented. However, in various other embodiments, the direction of motion of the pull tab 7 may be partially offset from the plane along which to connecting plate 5 is oriented. The pull tab 7 depicted in FIGS. 1D-1E is shown as annular in shape, however the pull tab 7 may be designed to possess any suitable shape for mating with the pull track 9 and permitting motion in an operative direction along a length of the pull track 9 such that the locking member 17 is engaged and released from the connector post 15 responsive to said motion.

In various embodiments, the distance between an outer surface of the connecting plate 5 and an outer surface of the backplate 13 is between 1 mm and 20 mm, for example 7 mm. In certain embodiments, the distance between an inner surface of the connecting plate 5 and an inner surface of the backplate 13 is between 0.5 mm and 15 mm, for example 3.2 mm.

Figure 2B:
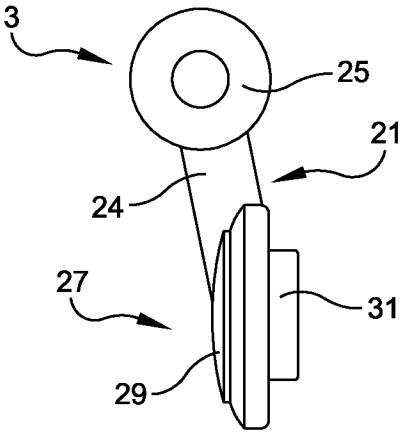
FIG. 2B depicts a side view of the strap connector in one implementation of this disclosure.
Figure 2D:
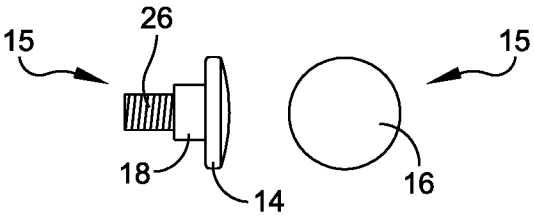
FIG. 2D depicts the strap connector post in one implementation of this disclosure.
Figure 2A:
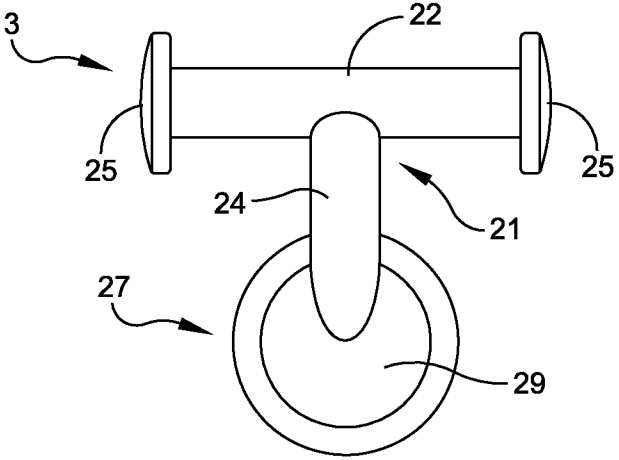
FIG. 2A depicts a top view of a strap connector in one implementation of this disclosure.

FIG. 2A depicts a top view of a strap connector 3 in one implementation of this disclosure. In this example, strap connector 3 may comprise a T-shaped bar 21. In this example, the horizontal portion 22 of T-shaped bar 21 may be intended to be fastened to a strap 23 (shown in FIGS. 11A and 11B). T-shaped bar 21 may be wrapped in an end portion of strap 23 which may be stitched to itself to secure T-shaped bar 21 as shown, for example, in FIGS. 11A and 11B. In other examples, strap 23 may be fastened to strap connector 3 using any suitable means known to one of ordinary skill in the art, including gluing, stitching, integrally forming, or using a mechanical fastener. In some examples a T-shaped bar 21 may not be necessary and a strap 23 may be fastened directly to a portion of strap connector 3 using any suitable means known to one of ordinary skill in the art. Where a T-shaped bar 21 is employed, it may also include flanged ends 25 to help retain strap 23 on T-shaped bar 21.

The vertical portion 24 of T-shaped bar 23 may extend from the horizontal portion at one end to a plug 27 at an opposite end. Plug 27 may be integrally formed of the same materials as T-shaped bar 21, which can include any suitably rigid materials, such as metal, plastic, rubber, or wood as known to one of ordinary skill in the art. Alternatively, plug 27 may be fastened to T-shaped bar 21 using a mechanical fastener or welding or soldering it to the T-shaped bar 21. The plug 27 may comprise a top cap 29 that may abut connector plate 5 when strap connector 3 is engaged with connector plate 5. Plug 27 may further comprise a projection 31 that may extend within or through the connector bore 11 into the connector plate 5 when strap connector 3 is engaged with connector plate 5 as shown, for example, in FIG. 2B. The size of the projection 31 may be made to substantially match the size of the connector bore 11 (or slightly smaller) such that the projection 31 may mate with the connector bore 11 while the connector post 15 is in the locked position. The outer lateral faces of the projection 31 are provided to substantially abut the inner lateral faces of the connector bore 11, for example, to provide lateral stability to the strap connector 3 while in the locked position such that the strap connector 3 cannot be laterally or transversely displaced relative to the connector plate 5 (although rotational displacement may still be possible due to the circular shape of the projection 31 and the connector bore 11).

Figure 2C:
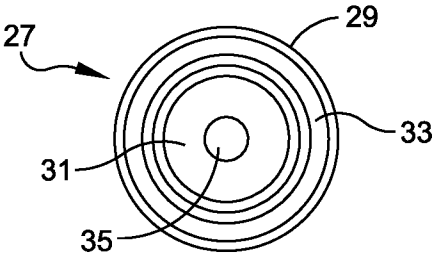
FIG. 2C depicts a bottom view of a strap connector post in one implementation of this disclosure.

FIG. 2C depicts a bottom view of the plug 27 portion of strap connector 3 in one implementation of this disclosure. As shown in FIG. 2C, plug 27 may include an O-ring 33 that may be formed of an epoxy, rubber, silicone, or any other suitable substance for cushioning the connection between plug 27 and connector plate 5 so as to avoid scratching or otherwise damaging connector plate 5. Projection 31 may also include a hole or opening 35, substantially at its center for receiving a strap connector post 15. In some examples, opening 35 may be threaded for receiving a threaded upper portion 26 of connector post 15. In other examples, connector post 15 may be fixed to one or more structures or surfaces within the opening 35 using a suitable attachment method known to those skilled in the art, such as adhesive, welding, soldering, etc. In other examples, connector post 15 may be integrally formed with strap connector 3 by using a single cast or mold.

FIG. 2D depicts a strap connector post 15 in one implementation of this disclosure. In this example, strap connector post 15 may include an attachment portion 26, a post portion 18, and a flanged end 14 for mating with the locking member 17 when strap attachment device 1 is in the locked or closed position. The flanged end 14 may also include a lower surface 16 that may initially contact locking member 17. In some examples, the lower surface of the flanged end may include a curved or rounded lower surface 16 so as to cooperate with a ramped portion of locking member 17, thereby causing locking member 17 to retract as the spring 19 (or other mechanical biasing mechanism) compresses. Connector post 15 may be fixedly attached to plug 27 and/or top cap 29 using any suitable means known to one of ordinary skill in the art. For example, the attachment portion 26 may be threaded as shown in FIG. 2D and configured to be removably or permanently attached to the plug 27 via the hole 35, the hole 35 being adapted to receive the threaded end 26 and fix the connector post 15 relative to the plug 27. In other embodiments, the connector post 15 may instead be integral with, soldered to, or otherwise permanently attached to the plug 27. Connector post 15 may also be formed of the same materials as the remainder of strap connector 3, such as a suitably rigid metal, plastic, or rubber, or any other suitably rigid material known to one of ordinary skill in the art.

In various embodiments, the depth of the flanged end 14 including the lower surface 16 is between 0.5 mm and 8 mm, for example 2 mm. The depth of the post portion 18 may be between 0.5 mm and 10 mm, for example 2.5 mm. The diameter of the flanged end 14 may be between 2 mm and 30 mm, for example 9 mm. The length of the horizontal portion 22 of the strap connector 3 may be between 5 mm and 100 mm, for example 25 mm. The width of the horizontal portion 22 of the strap connector 3 may be between 1 mm and 20 mm, for example 5 mm. The outer diameter of the connector bore 11 including the perimeter portion 12 may be between 4 mm and 64 mm, for example 16 mm. The inner diameter of the connector bore 11 excluding the perimeter portion 12 may be between 3 mm and 48 mm, for example 12 mm. The diameter of the flanged ends 25 of the strap connector 3 may be between 2 mm and 50 mm, for example 10 mm. The depth of the top cap 29 of the plug 27 may be between 1 mm and 16 mm, for example 4 mm.

Figure 3C:
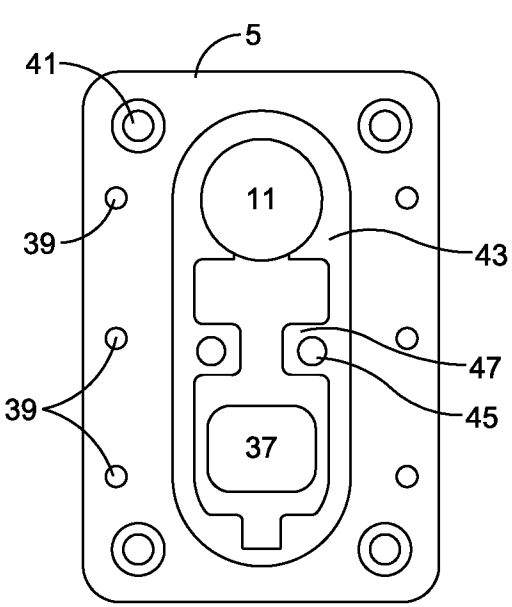
FIG. 3C depicts a bottom view of the connector plate in one implementation of this disclosure.
Figure 3B:
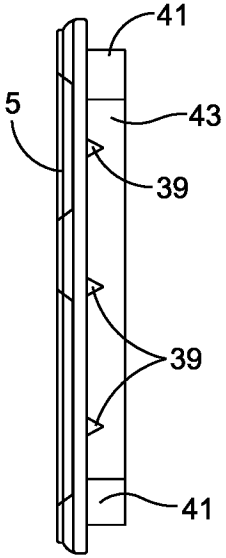
FIG. 3B depicts a side view of the connector plate in one implementation of this disclosure.
Figure 3A:
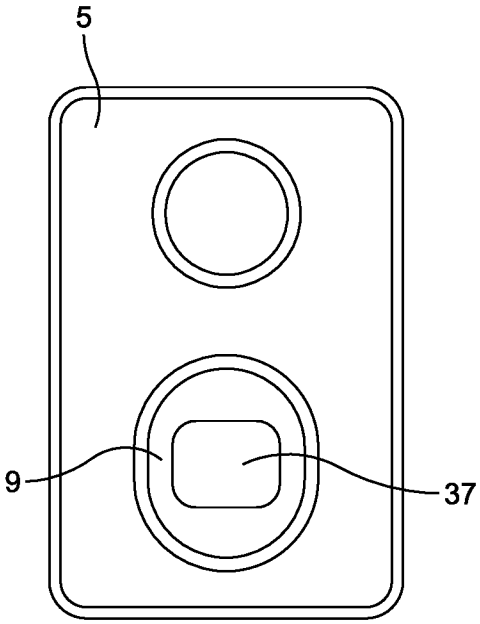
FIG. 3A depicts a top view of a connector plate in one implementation of this disclosure.

FIGS. 3A-3C respectively depict top, side, and bottom views of the connector plate 5 in one implementation of this disclosure. Referring to FIGS. 3A-3C, the connector plate 5 may comprise any suitably rigid material for fastening to a bag or luggage item and for housing a locking mechanism, such as such as a suitably rigid metal, plastic, or rubber, or any other suitably rigid material known to one of ordinary skill in the art. On a top surface, connector plate 5 may include the connector bore 11 for receiving the projection 31 and/or the strap connector post 15. The top surface may also include a recessed pull track 9 for guiding pull tab 7, along with a pull tab bore 37 through which the pull tab 7 may pass to connect with the locking member 17.

As shown, for example, in FIGS. 3B and 3C, the underside of connector plate 5 may also include one or more barbs 39 to help hold connector plate 5 in place against the surface of a bag or luggage item. The underside of connector plate 5 may also include one or more posts 41 projecting from the underside of connector plate 5 so as to extend through the outer surface of a bag or luggage item and provide a fastening point for the backplate 13 or optional backing surface 75 (shown in FIG. 8). A locking member housing 43 may also be disposed on the underside of connector plate 5 and may comprise a housing that is integrally formed with connector plate 5. In some examples, locking member housing 43 may further surround connector bore 11 as well as pull tab bore 37. Locking member housing 43 may also include a recessed portion for housing locking member 17 and spring 19, while allowing locking member 17 to slide between an open and closed position. In some examples, the inner shape of locking member housing 43 may allow locking member 17 to slide between an open and closed position, while preventing locking member 17 from immovably blocking the path of connector post 15 when it is inserted into connector bore 11. In some examples, locking member 17 may be prevented from immovably blocking the path of connector post 15 by one or more projections 47 within locking member housing 43 that may limit the movement of locking member 17. In other examples, the movement of locking member 17 may be restricted by the dimensions of pull tab bore 37 which may also restrict the movement of locking member 17. Locking member housing 43 may also comprise one or more bores or openings 45 for receiving a fastener for connecting housing cover 49 (shown in FIGS. 5A and 5B). Bores 61 of connecting housing cover 49 may be configured to align with bores 45 of locking member housing 43 and secured using a fastening means known to those skilled in the art, for example via fastening screws 67 (shown in FIG. 6D).

In various embodiments, the length of the pull track 9 is between 4 mm and 64 mm, for example 16 mm. The depth of the connecting plate 5 may be between 0.5 mm and 10 mm, for example 2.2 mm. The depth of the locking member housing 43 may be between 0.5 mm and 12 mm, for example 3.2 mm. The width of the connecting plate 5 may be between 7 mm and 100 mm, for example 28 mm. The height of the connecting plate 5 may be between 13 mm and 150 mm, for example 42 mm. The width of the locking member housing 43 may be between 3 mm and 50 mm, but will be less than the width of the connecting plate 5. The height of the locking member housing 43 may be between 6 mm and 75 mm, but will be less than the height of the connecting plate 5.

Figure 4B:
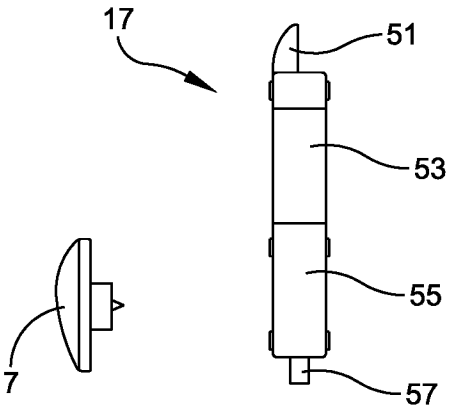
FIG. 4B depicts a side view of the locking member in one implementation of this disclosure.
Figure 4A:
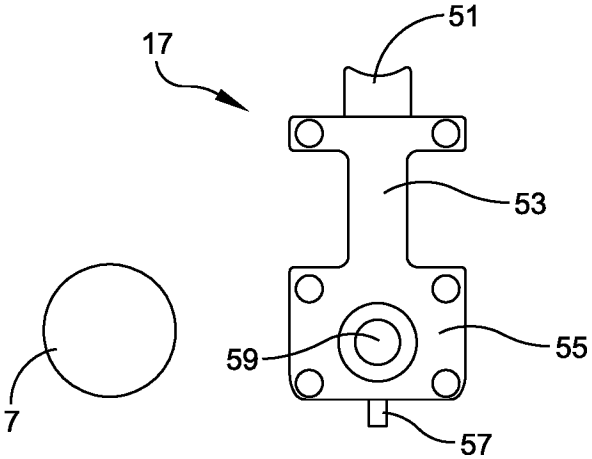
FIG. 4A depicts a top view of a locking member in one implementation of this disclosure.

FIGS. 4A and 4B respectively depict top and side views of the locking member 17 in one implementation of this disclosure. Referring to FIGS. 4A and 4B, in some examples, locking member 17 may comprise a locking point 51 disposed on front end of the locking member 17. Locking point 51 may include a top surface that ramps downward, as shown for example in FIG. 4B. The downward slope of locking point 51 may cause locking member 17 to retract (and spring 19 or other mechanical biasing means to compress) when locking point 51 contacts the lower surface of connector post 15. Once the flanged end of connector post 15 passes locking point 51, spring 19 may be partially or fully released and locking point 51 may engage with the post portion 18 (shown in FIG. 2D) of connector post 15 thereby retaining the flanged portion 15 beneath locking point 51. In some examples, the leading edge of locking point 51 may be generally concave so that connector post 15 (and by extension strap connector 3) may rotate freely, even when locking member 17 is engaged. In alternative examples, a separate locking point 51 may not be required, and the main body of locking member 17 may be used to engage with and lock connector post 15 in place. In some examples, more than one locking point 51 may be attached to the locking member 17 and each configured to couple with the connector post 15, for example, to increase locking strength.

As shown, for example, in FIG. 4A, locking member 17 may also include a neck 53 and a flanged base 55. Neck portion 53 may be somewhat narrower, allowing it to slide between projections 47 in locking member housing 43. Flanged base 55 may likewise allow projections 47 in locking member housing 43 to limit how far locking member 17 may slide, thereby preventing it from immovably blocking the path of connector post 15 during insertion. Locking member 17 may also include a spring guide 57, which may include a projection disposed on a rear end of locking member 17, as shown for example in FIGS. 4A and 4B. Spring guide 57 may serve as a guide for mounting spring 19 between locking member 17 and the inner wall of locking member housing 43. Once installed, spring guide 57 may also help to retain spring 19 in its proper position. In some embodiments, the spring guide 57 may be attached to the spring 19 (or other mechanical biasing means) using a pin, screw, rivet, hole, or other mechanical fastening means known to those in the art. Locking member 17 may also include a bore or opening 59, which may be disposed within flanged base 55 to which pull tab 7 may be attached. Pull tab 7 preferably has a top surface diameter greater than a diameter of pull tab bore 37 and, once attached to locking member 17, helps to maintain locking member 17 against the lower surface of connector plate 5 and within locking member housing 43.

In various embodiments, the depth of the locking member 17 is between 0.5 mm and 15 mm, for example 3 mm. The depth of the pull tab 7 may be between 0.5 mm and 15 mm, for example 3 mm. The diameter of the pull tab 7 may be between 3 mm and 48 mm, for example 12 mm. The width of the locking member 17 may be between 2 mm and 40 mm, for example 10.5 mm. The height of the locking member 17 may be between 5 mm and 80 mm, for example 21 mm.

Figure 5B:
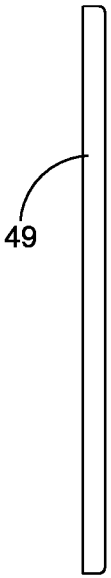
FIG. 5B depicts a side view of the cover in one implementation of this disclosure.
Figure 5A:
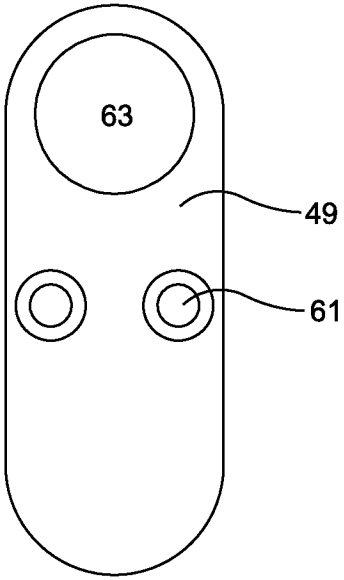
FIG. 5A depicts a bottom view of a cover in one implementation of this disclosure.
Figure 6C:
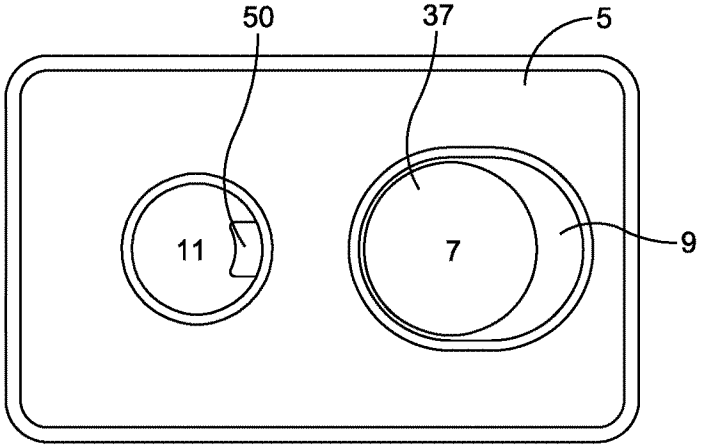
FIG. 6C is a top view of the locking member in the process of being assembled into the connector plate in one implementation of this disclosure.
Figure 6D:
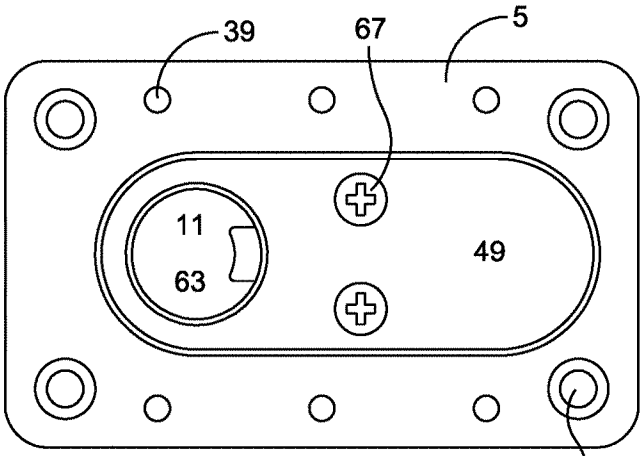
FIG. 6D is a bottom view of the locking member in the process of being assembled into the connector plate in one implementation of this disclosure.

FIGS. 5A and 5B respectively depict a bottom view and a side view of housing cover 49 in one implementation of this disclosure. As shown in FIG. 5A, housing cover 49 may include a shape that generally matches the shape and dimensions of locking member housing 43 and may be installed over the open bottom of locking member housing 43 so as to retain locking member 17 within the housing and protect the spring 19. Housing cover 49 may also include two bores 61 corresponding to the position of bores 45 in locking member housing 43 and through which a fastener may be inserted or screwed. In other examples, bores 61 or 45 may not be necessary and housing cover 49 may be attached to the underside of connecting plate 5 using any suitable means known to one of ordinary skill in the art. In some examples, housing cover 49 may also include a hole or opening 63 that generally corresponds to the shape, size, and location of connector bore 11 in connector plate 5. Hole 63 may provide a viewing window to allow a user to visibly inspect the operation of locking member 17 to ensure that it is still working properly. However, hole 63 may not be necessary in other examples, where housing cover 49 may comprise a substantially complete cover for locking member housing 43.

In various embodiments, the height of the housing cover 49 is between 8 mm and 140 mm, for example 35.7 mm. The width of the housing cover 49 may be between 3 mm and 56 mm, for example 13.7 mm. The depth of the housing cover 49 may be between 0.4 mm and 8 mm, for example 1.6 mm.

Figure 6A:
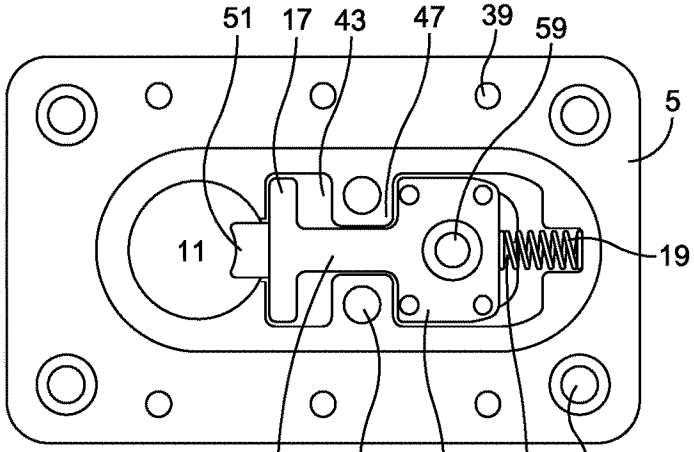
FIG. 6A depicts a bottom view of the locking member in the process of being assembled into the connector plate in one implementation of this disclosure.
Figure 6B:
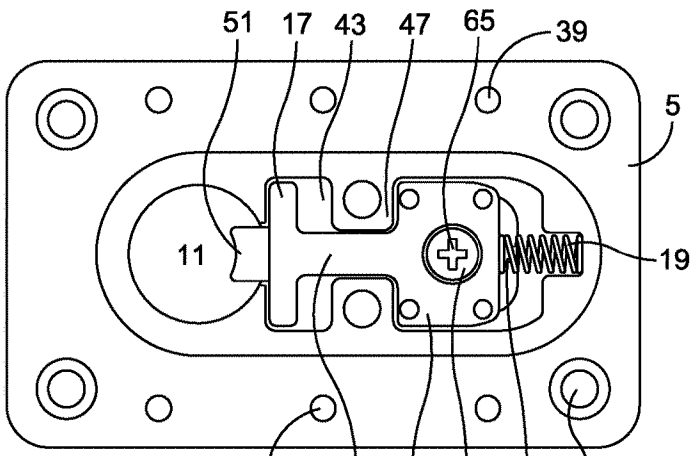
FIG. 6B depicts a bottom view of the locking member in the process of being assembled into the connector plate in one implementation of this disclosure.

FIGS. 6A-6D depict the process of assembling locking member 17 into connector plate 5 in one implementation of this disclosure. As shown in FIG. 6A, in a first step, locking member 17 may be disposed within locking member housing 43 such that neck portion 53 may be disposed between projections 47, and flanged base 55 may be disposed beneath pull tab bore 37. At the same time, spring 19 may be mounted upon spring guide 57 at one end and disposed within a recessed portion of the internal wall of locking member housing 43 at a second end. In a second step, locking member 17 may be fastened to pull tab 7 by threading screw 65 through bore 59 and pull tab bore 37, thereby fastening locking member 17 to pull tab 7 as shown, for example, in FIGS. 6B and 6C. In a third step, housing cover 49 may be secured to the lower surface of connecting plate 5 so as to cover locking member housing 43. In some examples, housing cover 49 may be secured by fastening screws 67 through bores 61 in housing cover 49 as well as bores 45 in locking member housing 43, although any suitable means of fastening known to one of ordinary skill in the art may be employed.

Figure 7:
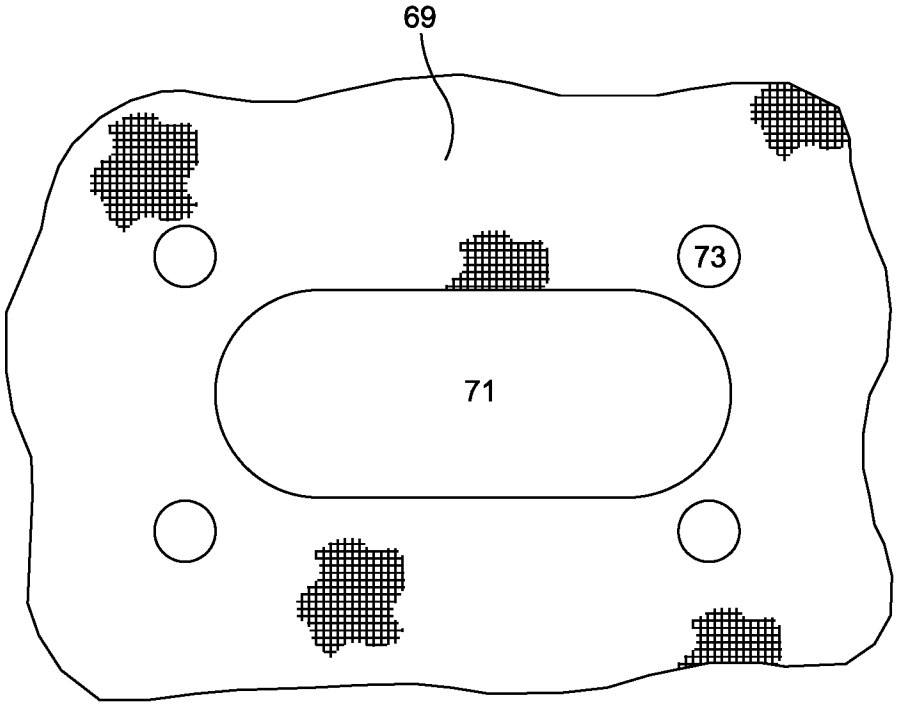
FIG. 7 depicts a top view of a surface preparation for a bag or luggage item for securing the strap attachment device in one implementation of this disclosure.

FIG. 7 depicts a top view of a surface preparation for a bag or luggage item for securing a strap attachment device in one implementation of this disclosure. As shown in FIG. 7, surface material 69 may comprise any suitable surface material for a bag or luggage item, such as leather, cloth, canvas, silk, wood, plastic, or other suitable baggage materials known to one of ordinary skill in the art. As shown, surface material 69 may be prepared by cutting an opening 71 that substantially matches the shape and dimensions of locking member housing 43 and/or housing cover 49 in the surface material. Surface material 69 may further be prepared by punching one or more holes 73, through which posts 41 are intended to be inserted. In some examples, holes 73 may substantially match the size, shape, and arrangement of posts 41 on connecting plate 5.

Figure 8:
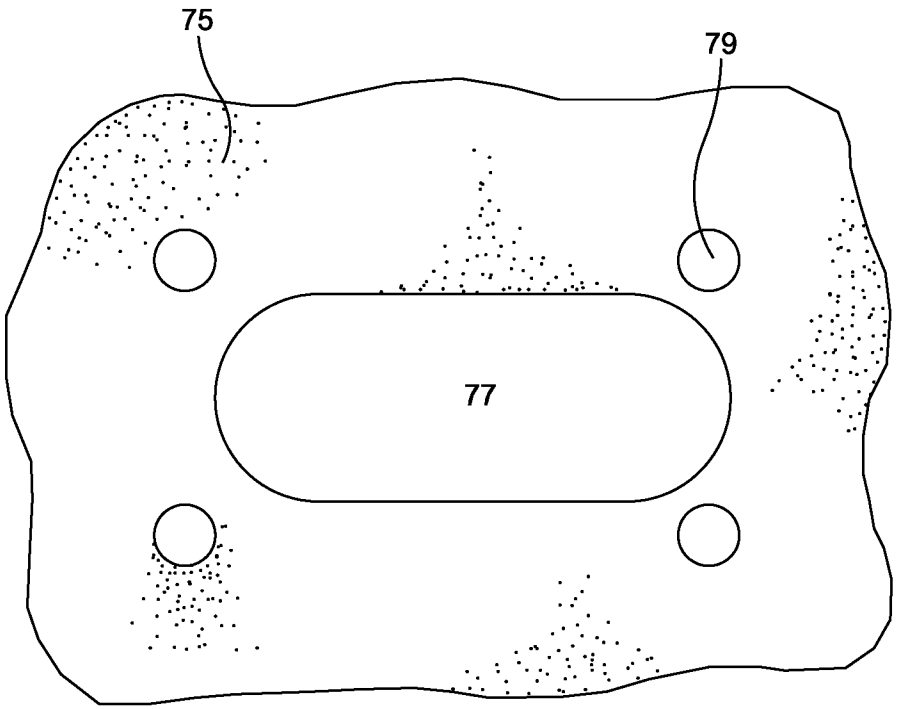
FIG. 8 depicts a bottom view of the surface backing for a bag or luggage item for securing the strap attachment device in one implementation of this disclosure.

FIG. 8 depicts a bottom view of an optional backing material 75 for a bag or luggage item for securing strap attachment device 1 in one implementation of this disclosure. As shown in FIG. 8, optional backing material 75 may comprise any suitable material for providing additional support to surface material 69 and to prevent unwanted damage to surface material 69 that may be caused by fastening the strap attachment device 1 or from the forces exerted by the strap 23. Suitable materials may include leather, cloth, canvas, wood, plastic, rubber, foam, metal, or any other suitable materials known to one of ordinary skill in the art to serve as a backing. As shown, backing material 75 may be prepared by cutting a section of material that is at least as large as the dimensions of connecting plate 5, but preferably somewhat larger. An opening 77 that substantially matches the shape and dimensions of the locking member housing 43, the housing cover 49, or the surface material opening 71 may also be cut in backing 75. Backing material 75 may further be prepared by punching one or more holes 79, through which posts 41 are intended to be inserted, similar to the holes 73 on the surface material 69. In some examples, holes 79 may substantially match the size, shape, and arrangement of posts 41 on connecting plate 5. Once backing material 75 has been prepared it may be attached to the back of surface material 69 such that opening 71 substantially aligns with opening 77 and one or more holes 73 substantially align with one or more holes 79. Backing material 75 may be attached to the back of surface material 69 using any suitable means of attachment known to one of ordinary skill in the art, such as gluing, stitching, or a combination thereof.

Figure 9:
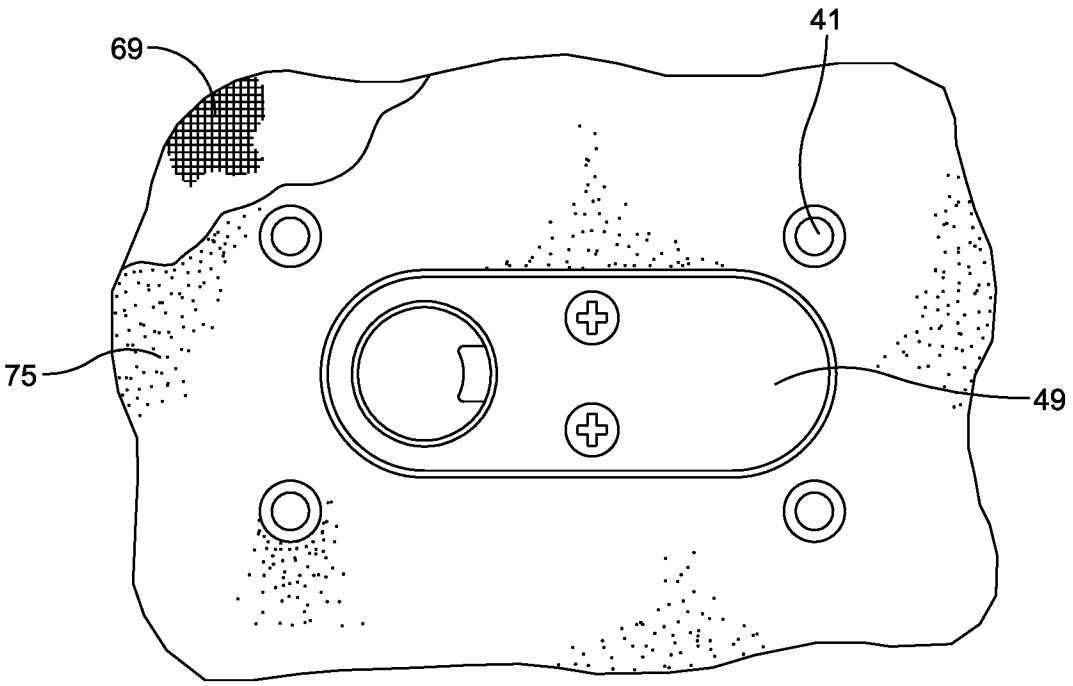
FIG. 9 depicts a bottom view of the connection plate after it has been inserted through the surface preparation and backing for a bag or luggage item in one implementation of this disclosure.

FIG. 9 depicts a bottom view of a connection plate 5 after it has been inserted through a surface material 69 and a backing material 75 for a bag or luggage item in one implementation of this disclosure. The assembled connection plate 5 is inserted through openings 71 and 77 (as shown in FIGS. 7-8) such that housing cover 49 occupies the openings 71, 77 and partially protrudes through the backing material 75. Posts 41 may also be inserted through one or more of the holes 73 and 79 (as shown in FIGS. 7-8).

Figure 10B:
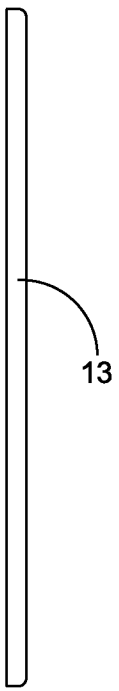
FIG. 10B depicts a side view of a backplate according to one implementation of this disclosure.
Figure 10A:
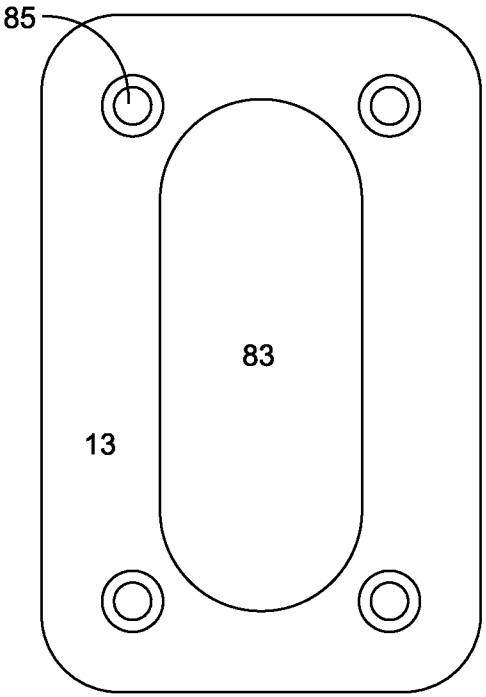
FIG. 10A depicts a bottom view of a backplate according to one implementation of this disclosure.

FIGS. 10A and 10B respectively depict a bottom view and a side view of the backplate 13 according to one implementation of this disclosure. In some examples, the backplate 13 may include a central opening 83 that substantially matches the size and shape of housing cover 49. Backplate 13 may also comprise bores or openings 85 that substantially match the size and arrangement of holes 73 and 79, as well as posts 41. In some examples, backplate 13 may secure connection plate 5 upon surface material 69 or backing material 75 via one or more threading screws (not shown), which are inserted through corresponding the bores 85 and holes 73, 79 in order to fasten the backplate 13 to the posts 41. In other examples, mechanical fasteners inserted through bores 85 may not be required and backplate 13 may instead be secured to the connection plate 5 using other suitable means of attachment known to those of ordinary skill in the art.

In various embodiments, the width of the backplate 13 is between 8 mm and 130 mm, for example 32 mm. The height of the backplate 13 may be between 11 mm and 190 mm, for example 46 mm. The depth of the backplate 13 may be between 0.3 mm and 6 mm, for example 1.3 mm.

Figure 11B:
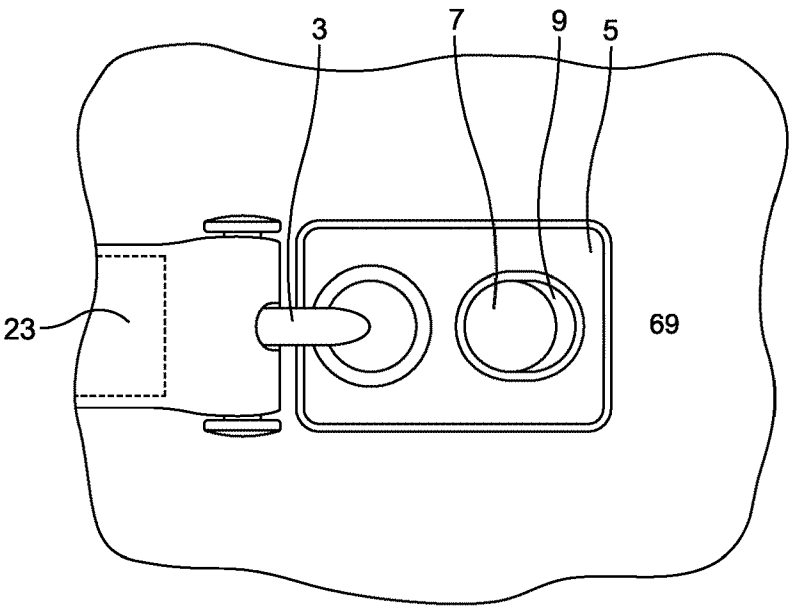
FIG. 11B depicts a perspective view of a fully assembled strap connector device in a closed position according to one implementation of this disclosure.
Figure 11A:
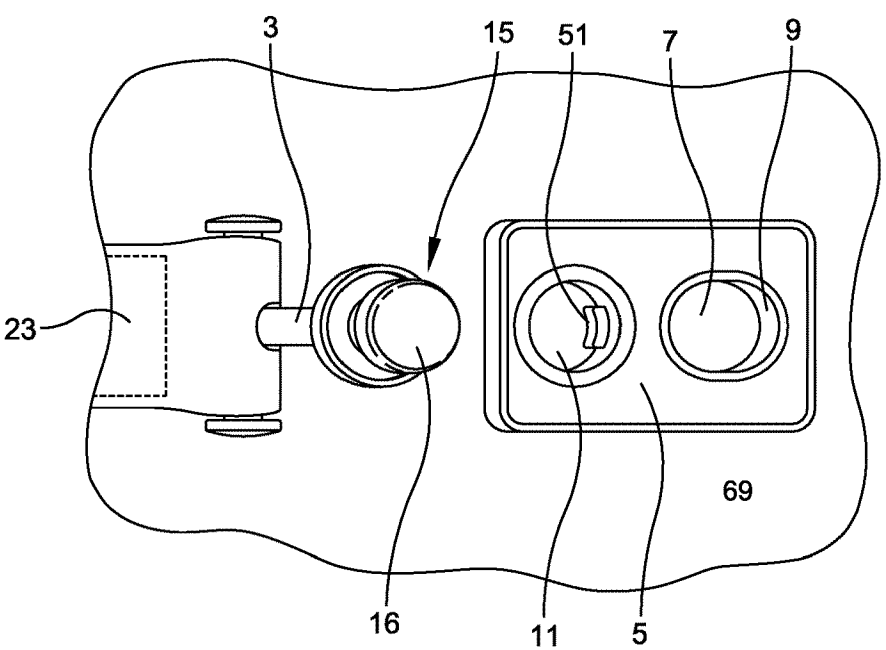
FIG. 11A depicts a perspective view of a fully assembled strap connector device in an open position according to one implementation of this disclosure.

FIGS. 11A and 11B depict perspective views of a fully assembled strap connector in an open and closed position, respectively, according to one implementation of this disclosure. As shown, strap connector 3 may be inserted into connecting plate 5 by inserting connector post 15 into connector bore 11. Once inserted, locking point 51 may engage above the flanged end of connector post 15, thereby temporarily attaching strap connector 3 (and strap 23) to connecting plate 5. Notably, a user need not first disengage locking member 17 before inserting connector post 15. Because connector post 15 may have a curved or rounded lower surface 16, and locking point 51 may be ramped, locking member 17 may retract and engage with connector post 15 using nothing more than a downward force on strap connector 3. In some examples, connecting plate 5, strap connector 3, or connector post 15 may be magnetized so as to help guide strap connector 3 into proper alignment with connector bore 11. The locking member 17 may further include a locking point 51 (as shown in FIG. 4A) adapted to directly abut a body section 18 of connecting post 15 such that the body section 18 may rotate freely relative to the locking member 17 without disengaging the locking member 17 from the connector post 15. Furthermore, the locking point 51 may provide a concave leading edge or surface to engage with a cylindrical body section 18 of the connector post 15, allowing an amount of surface area of the concave leading edge abutting the body section 18 to be increased while still allowing for the body section 18 to rotate freely relative to the leading portion of the locking point 51. Maximizing the amount of surface area contact between the leading portion of the locking point 51 and the body section 18 of the strap connector 3 may, for example, reduce the likelihood of an accidental or inadvertent disconnection. Finally, to remove strap connector 3, a user may simply pull downward on pull tab 7 thereby disengaging locking member 17 and compressing spring 19 before removing strap connector 3.

While the disclosed subject matter is described herein in terms of certain exemplary implementations, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other implementations having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A strap attachment device including a connecting plate configured to be attached to a surface material and a strap connector configured to be attached to a strap, comprising:

the connecting plate including a connector bore, the connecting plate being oriented along a first plane;

the strap connector including a flanged connector post configured to be removably inserted into the connector bore;

a locking member configured to releasably engage with the flanged connector post to retain the flanged connector post in an engaged position such that the flanged connector post cannot be displaced in a direction orthogonal to the first plane while engaged; and a plug disposed on the strap connector, the plug having a circular projection configured to receive an attachment portion of the flanged connector post, and the circular projection being configured to mate with an inner surface of the connector bore such that the flanged connector post cannot be displaced in a direction parallel to the first plane while engaged, but may rotate in a radial direction parallel the first plane.

2. The strap attachment device of claim 1 further comprising:

a pull track disposed on the connecting plate;

a pull tab disposed within the pull track and attached to the locking member, the pull tab configured to disengage the locking member from the flanged connector post responsive to a force causing the pull tab to move within the pull track in a direction parallel to the first plane.

3. The strap attachment device of claim 2, wherein the strap connector further includes a T-shaped bar configured for fastening to the strap and connected to the flanged connector post.

4. The strap attachment device of claim 3, wherein the locking member is a spring-loaded locking member that is biased to the engaged position via a spring.

5. The strap attachment device of claim 4, wherein the spring-loaded locking member further includes a ramped locking point positioned at a leading edge of the spring-loaded locking member such that a ramped edge of the ramped locking point faces the connecting plate.

6. The strap attachment device of claim 5, wherein the flanged connector post further includes a rounded lower surface configured to engage with the ramped locking point so as to cause the spring-loaded locking member to retract when the flanged connector post is inserted into the connecting bore and contacts the ramped locking point.

7. A bag comprising the strap attachment device according to claim 1, the bag further comprising:

a strap; and the surface material; and wherein the connecting plate is disposed on the surface material and the strap connector is attached to the strap.

8. The bag of claim 7 further comprising:

a pull track disposed on the connecting plate;

a pull tab disposed within the pull track and attached to the locking member, the pull tab configured to disengage the locking member from the flanged connector post responsive to a force causing the pull tab to move within the pull track in a direction parallel to the first plane.

9. The bag of claim 8, wherein the strap connector further includes a T-shaped bar fastened to the strap and connected to the flanged connector post.

10. The bag of claim 9, wherein the locking member is a spring-loaded locking member biased to the engaged position via a spring.

11. The bag of claim 10, wherein the spring-loaded locking member further includes a ramped locking point positioned at a leading edge of the spring-loaded locking member such that a ramped edge of the ramped locking point faces the connecting plate.

12. The bag of claim 11, wherein the flanged connector post further includes a rounded lower surface configured to engage with the ramped locking point so as to cause the spring-loaded locking member to retract when the flanged connector post is inserted into the connecting bore and contacts the ramped locking point.

13. A strap attachment device including a connecting plate configured to be attached to a surface material and a strap connector configured to be attached to a strap, comprising:

the connecting plate including a connector bore, the connecting plate being oriented along a first plane;

the strap connector including a flanged connector post configured to be removably inserted into the connector bore;

a locking member configured to releasably engage with the flanged connector post to retain the flanged connector post in an engaged position such that the flanged connector post cannot be displaced in a direction orthogonal to the first plane while engaged;

a pull track disposed on the connecting plate; and a pull tab disposed within the pull track and attached to the locking member, the pull tab configured to disengage the locking member from the flanged connector post responsive to a force causing the pull tab to move within the pull track in a direction parallel to the first plane, wherein the strap connector further includes a T-shaped bar configured for fastening to the strap and connected to the flanged connector post, wherein the locking member is a spring-loaded locking member that is biased to the engaged position via a spring, wherein the spring-loaded locking member further includes a ramped locking point positioned at a leading edge of the spring-loaded locking member such that a ramped edge of the ramped locking point faces the connecting plate, wherein the flanged connector post further includes a rounded lower surface configured to engage with the ramped locking point so as to cause the spring-loaded locking member to retract when the flanged connector post is inserted into the connecting bore and contacts the ramped locking point, and wherein the flanged connector post further includes a cylindrical body portion disposed above said rounded lower surface and configured to engage with a leading surface of the ramped locking point when the spring-loaded locking member is in the engaged position.

14. The strap attachment device of claim 13, wherein the leading surface of the ramped locking point is concave and configured to contact the cylindrical body portion such that the cylindrical body portion can rotate freely in a radial direction relative to the ramped locking point without reducing an amount of contact between the leading surface and the cylindrical body portion.

15. The strap attachment device of claim 14, further comprising a backplate attached to the connecting plate, the backplate configured to abut a surface of the surface material.

16. The strap attachment device of claim 15, further comprising a backing material configured to be disposed between the surface material and the backplate.

17. A bag comprising the strap attachment device according to claim 7, the bag further comprising:

a strap; and the surface material; and wherein the connecting plate is disposed on the surface material and the strap connector is attached to the strap.

18. The bag of claim 17, wherein the leading surface of the ramped locking point is concave and configured to contact the cylindrical body portion such that the cylindrical body portion can rotate freely in a radial direction relative to the ramped locking point without reducing an amount of contact between the leading surface and the cylindrical body portion.

19. The bag of claim 18, further comprising a backplate attached to the connecting plate, the backplate configured to abut a surface of the surface material.

20. The bag of claim 19, further comprising a backing material configured to be disposed between the surface material and the backplate.

* * * * *